United States Patent [19]

Barr

[11] 4,373,594

[45] Feb. 15, 1983

[54] ROTARY DRILL BIT

[76] Inventor: Thomas R. Barr, P.O. Box 251, Denison, Tex. 75020

[21] Appl. No.: 291,759

[22] Filed: Aug. 10, 1981

[51] Int. Cl.[3] ..... E21B 10/60

[52] U.S. Cl. ..... 175/393; 175/391

[58] Field of Search ..... 175/339, 340, 391, 393, 175/421; 408/59, 205, 207, 229

[56] References Cited

U.S. PATENT DOCUMENTS

| | | | |
|---|---|---|---|
| 1,830,074 | 11/1931 | Rabichaux | 175/421 |
| 2,149,798 | 3/1939 | Starkey | 175/393 |
| 2,776,115 | 1/1957 | Williams, Jr. | 175/339 |
| 2,950,089 | 8/1960 | Irons | 175/391 |

*Primary Examiner*—Stephen J. Novosad
*Assistant Examiner*—Joseph Falk
*Attorney, Agent, or Firm*—William J. Scherback

[57] ABSTRACT

Described is a rotary drill bit comprising a hollow body having a closed lower end and means on the upper end for securing the body to the lower end of a drill string. The body is provided with a plurality of flow passages and a deflecting means is provided to deflect upwardly and away from the flow passages cuttings and the like to avoid plugging the passages during drilling while permitting unimpeded flow from the passages of all the fluid passing through the hollow body.

4 Claims, 3 Drawing Figures

ROTARY DRILL BIT

BACKGROUND OF INVENTION

1. Field of Invention

The present invention relates to rotary drill bits particularly bits of the drag type having provision therein for transmitting through a head portion of the drill bit a fluid which during the course of drilling is utilized both to cool the cutting edges and to conduct cuttings to the surface.

2. The Prior Art

It is conventional to drill bit technology to provide means in the drill bit for circulating fluid to the bottom of the well being drilled. Thus the prior art is replete with drill bits having means for circulating fluid to the bottom of the well being drilled so that the cutting blades or edges of the drill bit may be lubricated and cooled by the fluid and the cuttings carried upward by the fluid to preclude sticking of the drill bit by such cuttings.

An exemplary drill bit of the drag type is described in U.S. Pat. No. 3,163,244 to R. D. Zimmerman. Fluid from central passage 50 exits by way of passages 52 into the wellbore where it follows two paths, one downward for cooling the cutting edges and the other upward for carrying cuttings to the surface.

Another patent illustrating a drill bit with means for circulating fluid to the bottom of the well is U.S. Pat. No. 2,950,089 issued to R. D. Irons. In this patent flow of fluid out of passage 20 is directed downward by way of aperture 24 in a deflector having a web portion 23 and upward by way of an extended side flange 25.

In all cases the apertures which direct the fluid toward the bottom of the well being drilled for purpose of cooling the cutting surface are subject to being clogged by cuttings and other debris as pressure is exerted upon the drill bit while making hole. As a result the cutting surfaces begin to over heat and wear more rapidly. In some instances the apertures by which the fluid is emitted from the center of the bit are completely clogged thereby preventing cuttings from being carried to the surface.

SUMMARY OF THE INVENTION

In accordance with the present invention there is provided a drill bit having means for reducing the likelihood that fluid passages will be clogged, thereby extending the useful life of the cutting edges of the drill bit and rendering the drilling operation itself more efficient. More particularly the drill bit comprises a plurality of outwardly and downwardly extending cutting members on the exterior of and projecting laterally beyond the periphery of the body of the drill bit. The body is provided with a plurality of flow passages each of which opens downwardly and outwardly between two adjacent cutting members. A deflecting means is formed integrally with and exteriorly of the body of the drill bit between two adjacent cutting means for deflecting upwardly and away from the flow passages cuttings and the like to avoid plugging the passages during drilling while permitting unimpeded flow from the passages of all the fluid in said downward direction for cooling and lubricating the cutting means.

In one embodiment the deflecting means is a unitary part of the body of the drill bit and formed by cutting a recess that increase in depth toward the closed lower end of the body of the drill bit. The fluid passages open into the recesses.

DETAILED DESCRIPTION

Figure 1:
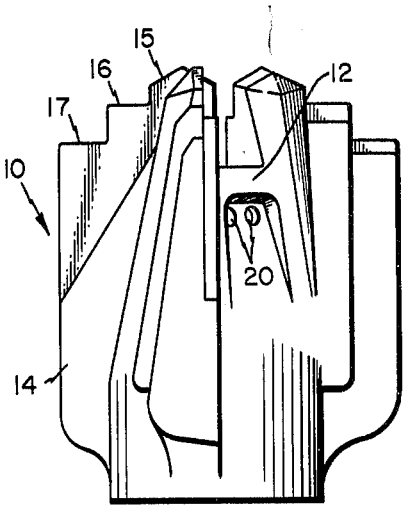
FIG. 1 is a side elevational view of a rotary drill bit embodying the invention.
Figure 2:
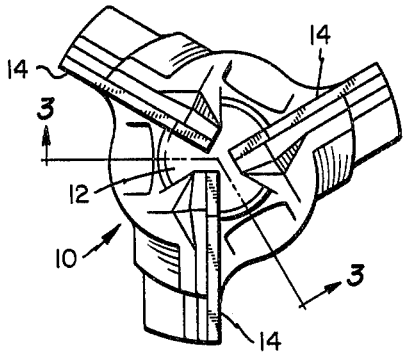
FIG. 2 is a top view of the drill bit.
Figure 3:
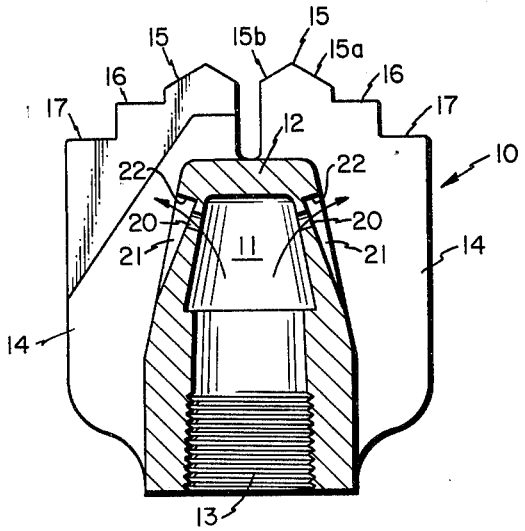
FIG. 3 is a sectional view of the drill bit taken along lines 3—3 of FIG. 2 for the purpose of illustrating the fluid passages and their relationship to the deflecting means formed on the body of the drill bit.

Referring now to the drawings a rotary drill bit 10 includes a hollow body 11 having a lower closed portion 12 and a conventional internally threaded portion 13 by means of which the drill bit may be secured to the lower end of a drill string. During drilling operations a fluid such as air or liquid, the latter being referred to as drilling mud, may be pumped or forced into the hollow body 11.

The lower closed portion 12 of the drill bit body is provided with a plurality of spaced radially outwardly extending cutting blades or members 14 each having stepped cutting edges 15, 16 and 17. The upper most cutting edge 15 of each blade may have a portion **15*a* which slopes outwardly and downwardly and a portion 15*b*** which slopes inwardly and downwardly from substantially the mid portion of such cutting edge.

The lower closed portion 12 of the hollow body 11 is provided with a plurality of flow passages 20, each of which is disposed between a pair of adjacent cutting blades 14. The flow passages 20 provide communication between the interior of the hollow body 11 and the exterior thereof to permit fluid circulated through the drill string into the bit body to flow outwardly therefrom to cool and lubricate the cutting blades 14 and also to carry off the cuttings produced in drilling operations.

The flow passages 20 extend downwardly and outwardly and have their outer ends disposed below the lowest cutting edge 17 so that the fluid flowing through these passages tend to be emitted as jets which are directed downwardly and outwardly toward the bottom of the wellbore adjacent the cutting edges of the blades.

The drill bit thus far described is conventional, but in the conventional mode the passageways 20 would extend to an unmodified outer surface of the hollow body portion 11. Such a drill bit has been found to be subject to clogging by cuttings that are forced during drilling operations into the passageways 20 interrupting the flow of fluid into the wellbore. In accordance with the present invention the body portion 11 is relieved at its outside surface over the passageways 20 in order to provide recesses 21. It will be observed that each of the recesses 21 increases in depth toward the closed lower end 12 of the body portion of the drill bit. In so doing there is provided a deflector which overhangs the passages 20 and which directs cuttings and the like away from the flow passages 20. The upper surfaces 22 of the recesses 21 are essentially parallel with the longitudinal axes of the flow passages 20 in order to avoid impeding the flow of fluid from the hollow portion 11 through the passageways into the wellbore.

The tapered nature of the recesses 21 also permit any cuttings or debris that might contact the body portion 11 beyond the passageways 20 to easily move upward and thereby avoid any build-up of cuttings or debris as might occur should the area around the passageways 20 merely be relieved as by counter drilling in and around the passageways 20.

While a preferred embodiment of the invention has been described, it will become apparent that other modifications might be made to the conventional drill bit in order to provide the deflecting action obtained by providing the recesses 21. For example, the surface around the closed end 12 might be enlarged circumferentially or other deflector embodiments might be provided so long as they meet the criteria of unimpeded flow from the passageways 20 as well as providing for the deflection of drill cuttings from the ends of the passages 20.

In FIG. 1 two passageways 20 are illustrated between adjacent cutting edges 14. However, one passage may do as well depending upon the amount of fluid to be utilized as well as the degree of jetting action desired.

What is claimed is:

1. A rotary drill bit comprising:

a hollow body having a closed lower end and means on the upper end for securing the body to the lower end of a drill string;

a plurality of outwardly and downwardly extending cutting members on the exterior of and projecting laterally beyond the periphery of said body, said body having a plurality of flow passages, each of said passages opening downwardly and outwardly along a longitudinal axis between each two adjacent cutting members; and deflecting means formed integrally with and exteriorly of said hollow body between each two adjacent cutting means for deflecting upwardly and away from said flow passages cuttings and the like to avoid plugging said passages during drilling, each longitudinal axis being oriented to direct fluid in a path to avoid contact with said deflecting means to permit unimpeded flow from said passages of all the fluid in said downward direction for cooling and lubricating said cutting members.

2. The rotary drill bit of claim 1 in which said deflecting means are located between said passageways and said lower end of said body.

3. A rotary drill bit comprising:

a hollow body having a closed lower end and means on the upper end for securing the body to the lower end of a drill string;

a plurality of outwardly and downwardly extending cutting members on the exterior of and projecting laterally beyond the periphery of said body, said body having a plurality of flow passages, each of said passages opening downwardly and outwardly between each two adjacent cutting members; and deflecting means formed integrally with and exteriorly of said hollow body between each two adjacent cutting means for deflecting upwardly and away from said flow passages cuttings and the like to avoid plugging said passages during drilling while permitting unimpeded flow from said passages of all the fluid in said downward direction for cooling and lubricating said cutting members;

said deflecting means are a unitary part of said body and are formed by cutting a recess that increases in depth toward said closed lower end with said passages opening into said recesses.

4. A rotary drill bit comprising:

a hollow body having a closed lower end and means on the upper end for securing the body to the lower end of a drill string;

a plurality of outwardly and downwardly extending cutting members on the exterior of and projecting laterally beyond the periphery of said body, said body having a plurality of flow passages, each of said passages opening downwardly and outwardly between each two adjacent cutting members; and deflecting means formed integrally with and exteriorly of said hollow body between each two adjacent cutting means for deflecting upwardly and away from said flow passages cuttings and the like to avoid plugging said passages during drilling while permitting unimpeded flow from said passages of all the fluid in said downward direction for cooling and lubricating said cutting members;

the outer surface of said body being recessed at each location of a passage, with each recess increasing in depth toward the closed end of said body to provide body portions which overhang said passages to provide said deflecting means.

* * * * *